US011097297B1

(12) United States Patent
Scherer

(10) Patent No.: US 11,097,297 B1
(45) Date of Patent: Aug. 24, 2021

(54) LARGE TUBE COVER FOR PLUNGER TUBE

(71) Applicant: ALBEA THOMASTON INC., Wilmington, DE (US)

(72) Inventor: Christopher Scherer, Orange, CT (US)

(73) Assignee: SILGAN DISPENSING SYSTEMS THOMASTON CORPORATION, Wilmington, DE (US)

( * ) Notice: Subject to any disclaimer, the term of this patent is extended or adjusted under 35 U.S.C. 154(b) by 0 days.

(21) Appl. No.: 16/882,716

(22) Filed: May 25, 2020

(51) Int. Cl.
*B05B 11/00* (2006.01)

(52) U.S. Cl.
CPC ..... *B05B 11/3002* (2013.01); *B05B 11/0037* (2013.01); *B05B 11/0091* (2013.01); *B05B 11/3052* (2013.01)

(58) Field of Classification Search
CPC ..... B05B 11/3002; B05B 15/30; B05B 15/33; B05B 15/37; B65D 2231/004; B65D 2588/545; B65D 83/32
USPC ..... 222/464.1, 464.5
See application file for complete search history.

(56) References Cited

U.S. PATENT DOCUMENTS 1,991,720 A * 2/1935 Barreda ..... B67D 3/0012 222/464.2
2,083,776 A * 6/1937 Ferguson ..... B67D 1/0829 222/130
2,631,608 A * 3/1953 Rosenberg ..... B65D 47/263 137/576
3,272,402 A * 9/1966 Frangos ..... B65D 83/32 222/402.24
3,366,284 A * 1/1968 Marona ..... G01F 11/082 222/211
3,658,215 A * 4/1972 Ewald ..... B65D 83/32 222/402.18
4,019,661 A * 4/1977 Szabo ..... B05B 11/0059 222/376
4,524,458 A * 6/1985 Pongrass ..... B65D 77/06 383/33
4,821,923 A * 4/1989 Skorka ..... B05B 11/0081 222/80
4,826,031 A * 5/1989 Rusgitti ..... B05B 11/0037 220/4.21
4,865,232 A * 9/1989 Cassady, Jr. ..... B67D 7/0288 222/464.1
5,620,113 A * 4/1997 Meshberg ..... B05B 11/0013 222/1
6,119,897 A * 9/2000 Boileau ..... B65D 83/32 222/78
6,302,304 B1 * 10/2001 Spencer ..... B05B 11/3001 222/260
7,578,418 B2 * 8/2009 Milian ..... B05B 11/3042 222/321.9

(Continued)

*Primary Examiner* — Paul R Durand
*Assistant Examiner* — Michael J. Melaragno
(74) *Attorney, Agent, or Firm* — Steven M. Greenberg, Esq.; Shutts & Bowen LLP

(57) ABSTRACT

The invention concerns a system for dispensing a fluid product, including a device for taking off the product under pressure, the device having a body in communication with a plunger tube, the system further including a tube cover surrounding the plunger tube over at least part of its length. This system is characterized in that the tube cover is expandable between a shrink state and an expanded state, the width of the tube cover in the expanded state being larger than the width of the tube cover in the shrink state.

16 Claims, 7 Drawing Sheets

(56) References Cited

U.S. PATENT DOCUMENTS

| | | | | |
|---|---|---|---|---|
| 2006/0102660 | A1* | 5/2006 | Bichot | B05B 11/0038 222/321.9 |
| 2006/0243755 | A1* | 11/2006 | Hennen | B67D 7/0294 222/464.1 |
| 2011/0011895 | A1* | 1/2011 | Michitsuji | B05B 15/30 222/382 |
| 2011/0101038 | A1* | 5/2011 | Edmondson | B65D 88/548 222/464.1 |
| 2016/0296959 | A1* | 10/2016 | Yamaguchi | B65D 83/201 |
| 2018/0290169 | A1* | 10/2018 | Moreno Aparicio | B65B 3/32 |
| 2019/0022682 | A1* | 1/2019 | Scherer | B05B 11/3067 |
| 2020/0094278 | A1* | 3/2020 | Flynn | B05B 11/306 |

* cited by examiner

LARGE TUBE COVER FOR PLUNGER TUBE

BACKGROUND OF THE INVENTION

Field of the Invention

The invention relates to a system for dispensing a fluid product including a device for taking off the product under pressure, and more particularly to a dispensing flask including such dispensing system mounted on a reservoir for packaging the product, the reservoir having transparent or at least translucent walls.

Description of the Related Art

Dispensing systems equip flasks used in perfumery, in cosmetic, or for pharmaceutical treatments and usually include a reservoir for packaging the product. The taking off device is provided with a body mounted on the reservoir and in communication with a plunger tube arranged into the reservoir. The fluid product is sucked through the plunger tube, and then arrives into the body of the taking off device under the actuation of a push-button, before being dispensed through a nozzle.

In some applications, like cosmetic, the visibility of the plunger tube through the wall of the reservoir is judged as disgraceful. To solve this aesthetic problem, it is known to use a tube cover surrounding the plunger tube over at least part of its length so as to hide it. The tube cover may be chosen to introduce an attractive appearance in the reservoir.

The reservoir of the flask is provided with a neck that receives the taking off device. This neck is usually of a standard dimension, i.e. with a standard inner diameter, of 15 mm. As a result, the size of the tube cover is limited by this inner diameter as it has to pass through the neck of the reservoir with the plunger tube.

The external surface of the tube cover accommodates decorations, or writings, or the brand, etc. But sometimes this surface is not wide enough to display all the information, especially the surface visible by the user when the flask is in a facing position. To enlarge this visible surface, there is a need to enlarge the diameter of the tube cover. But then the tube cover cannot pass anymore into the neck of the reservoir.

To solve this problem, it is known to modify the size of the neck of the reservoir to make it larger, and to modify consequently the dimensions of the taking off device, so it can still fit with the neck. However, this customization is cost effective, as it is necessary to modify the corresponding molds.

BRIEF SUMMARY OF THE INVENTION

The concept of the present invention is to offer a wider surface of the tube cover, that is visible by the user when the flask is in a facing position, while still using a standard neck of the reservoir and a standard taking off device that fits with the neck.

To fulfill this objective, the invention discloses a system for dispensing a fluid product, including a device for taking off the product under pressure, the device having a pump in communication with a plunger tube, the system further including a tube cover surrounding the plunger tube over at least part of its length.

The system is mainly characterized in that the tube cover is expandable between a shrink state and an expanded state, the width of the tube cover in the expanded state being larger than the width of the tube cover in the shrink state.

The main idea of this invention is to provide an expandable tube cover, that can be in a shrink state for being able to pass through a standard neck of a reservoir, and then that can be deployed into the reservoir in order to widen the visible surface of the tube cover when the flask is in a facing position. As a result, it is possible to provide the tube cover with more decorations, writings, etc. All the usual inscriptions applied on the external surface of the reservoir can finally be applied on the tube cover. The reservoir itself can remain neutral for example, with its transparent or at least translucent walls.

According to different embodiments, that can be taken together or separately:

the tube cover includes an outer tube provided with an axial slit: this axial slit extends over the entire length of the outer tube. This axial slit has a minimal width when the tube cover is in the shrink state, and has a maximal width when the tube cover is in the expanded state.

the tube cover includes means for expanding the outer tube: thanks to these expanding means, the tube cover can switch from the shrink state to the expanded state.

the means for expanding the outer tube spread the slit and increase the width of the outer tube: increasing the width of the outer tube enable to increase the visible surface of the tube cover that is visible by the user when the flask is in a facing position.

the tube cover includes a collar to accommodate a neck of a container, the outer tube being directly linked to the collar by means of a rigid bridge: the tube cover is mounted on the neck of the container thanks to the collar that fits into it. And the outer tube is hold into place into the reservoir thanks to its connection with the collar, whatever the state of the tube cover.

the means for expanding the outer tube are arranged between the outer tube and the collar.

the means for expanding the outer tube are fastened to a surface of the outer tube and to a surface of the collar.

the means for expanding the outer tube are constrained in the shrink state of the tube cover and the means for expanding the outer tube are free in the expanded state of the tube cover: for inserting the tube cover into the reservoir, it is first necessary to constrain the expanding means in order to shrink the tube cover, so it can pass through the neck. Then it is possible to release the expanding means, so that the tube cover can reach its expanded state.

the tube cover further includes an inner tube to accommodate the body. The upper part of this inner tube is located into the collar, at the level of the neck of the reservoir. This upper part of the inner tube accommodates the body of the taking off device.

the means for expanding the outer tube are arranged between the outer tube and the inner tube.

the means for expanding the outer tube are fastened to a surface of the outer tube and to a surface of the inner tube.

the means for expanding the outer tube are constrained in the expanded state of the tube cover and the means for expanding the outer tube are free in the shrink state of the tube cover: the tube cover is first in a shrink state, so it is possible to insert it directly into the reservoir, and to position correctly the collar into the neck. Then, it is necessary to activate the expanding means so that the tube cover can reach its expanded state.

the inner tube is movable with respect to the outer tube between an upright position where the means for expanding are free and a lowered position where the means for expanding are constrained, the displacement of the inner tube between the upright position and the lowered position causing the expansion of the outer tube: there is a relative axial displacement on the inner tube with respect to the collar and the outer tube when the tube cover switches from one state to the other.

the mounting of the taking off device on the tube cover occurs the displacement of the inner tube from the upright position to the lowered position.

the means for expanding the outer tube consist of articulated legs, the tube cover being in the shrink state when the legs are folded, and the tube cover being in the expanded state when the legs are unfolded (deployed).

The invention also relates to a flask for dispensing a fluid product, the flask including:

a reservoir for packaging the product, the reservoir being provided with a neck, a dispensing system as described above that is mounted on the reservoir, the plunger tube of the dispensing system being disposed into the reservoir, the tube cover of the dispensing system being provided with a collar that accommodate the neck of the reservoir, the outer tube being inserted into the reservoir.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The invention will now be further described, by way of example only, with reference to the accompanying drawings, of which.

DETAILED DESCRIPTION OF THE INVENTION

Figure 1:
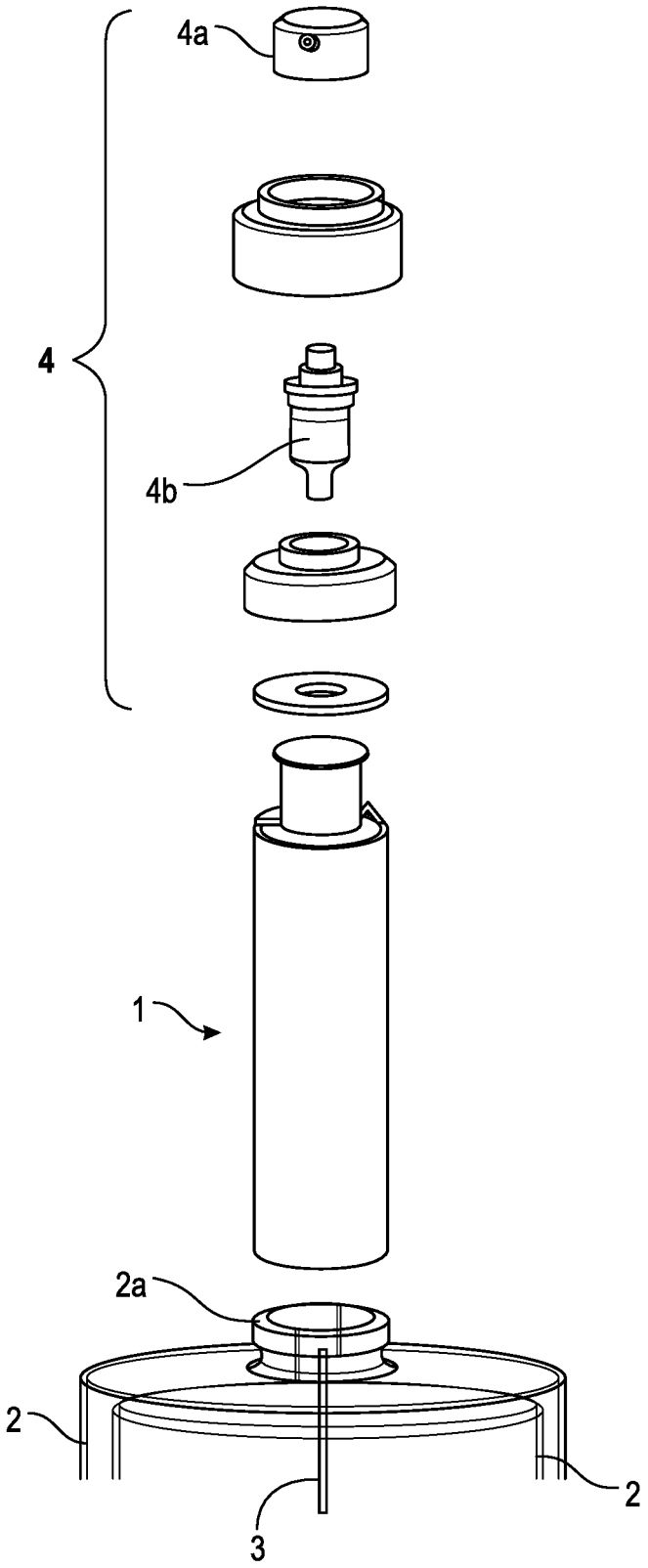
FIG. 1 is an exploded view of a flask for dispensing a product according to the invention.

In the description, the positioning terms in the space are referenced to the position of the flask as depicted in FIG. 1.

FIG. 1 illustrates a flask for dispensing a fluid product. This flask is in a facing position. This means that the flask is oriented such that the user sees the face of the flask that shows a mark (decoration, brand, etc.). The flask is provided with a dispensing nozzle whose dispensing orifice is oriented like the marked face.

The flask includes:

- a reservoir 2 for packaging the product, the reservoir being provided with a neck 2*a*,
- a dispensing system that is mounted on the reservoir 2 and that is provided with a plunger tube 3 disposed into the reservoir 2.

In particular examples, the product can be liquid, especially when it comes to cosmetic product, make-up, perfume, or pharmaceutical product. Preferably, the product is an alcoholic solution of perfume, especially colorless or lightly colored.

The reservoir 2 is provided with rigid walls surmounted by a neck 2*a*. The walls of the reservoir 2 are transparent or at least translucent so as to enable the vision of the product through it.

The dispensing system includes a device 4 for taking off the product under pressure stored into the reservoir 2. For example, this taking off device 4 includes a pump manually actuated by a push button 4*a* that is fed with the product under pressure in view of its dispensing.

The taking off device 4 includes a body 4*b* in communication with the plunger tube 3. It can be the body 4*b* of the pump. The body 4*b* has a pipe in which the plunger tube 3 is sleeved. So the product is taken off through the plunger tube 3, flows through the body 4*b*, then arrives up to a nozzle located in the push button 4*a* in this case, and is then dispensed outside the flask.

The dispensing system also includes a tube cover 1 surrounding the plunger tube 3 over at least a part of its length. This tube cover 1 has a geometry adapted for accommodating the plunger tube 3 inside.

The tube cover 1 is mainly composed of an outer tube 5 hiding the plunger tube 3, and a collar 6 that cooperates with the neck 2*a* of the reservoir 2. The outer tube 5 is fastened to the collar 6. The length of the collar 6 is equivalent to the length of a standard neck 2*a*. The outer tube 5 has an upper end 5*a* that is facing a lower end 6*b* of the collar 6. The outer tube 5 has a lower end 5*b* that is facing the bottom of the reservoir 2.

The outer tube 5 has an outer surface that is visible by the user through the walls of the reservoir 2. This outer surface can be used for displaying information about the product, about the brand, and/or for displaying decorations, etc.

According to the invention, the tube cover 1 is expandable between a shrink state and an expanded state, the width of the tube cover 1 in the expanded state being larger than the width of the tube cover 1 in the shrink state.

Figure 2:
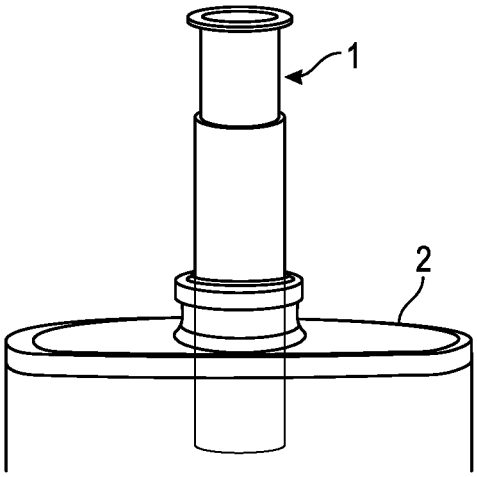
FIG. 2 illustrates the introduction of a tube cover according to the invention in a shrink state into a reservoir.

In FIG. 1, the tube cover 1 is in the shrink state. The tube cover 1 can be introduced into the neck 2*a* of the reservoir 2, as depicted in FIG. 2. The outer width of the tube cover 1 is just smaller than the inner width of the neck 2*a*, i.e. the inner diameter of the neck 2*a*, i.e. the inner standard diameter of a neck 2*a* that is around 15 mm.

Figure 3:
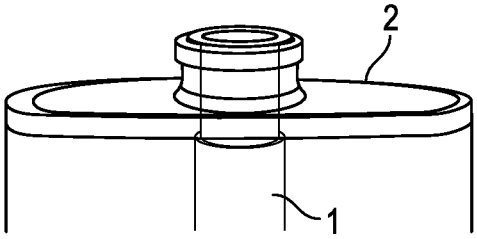
FIG. 3 illustrates a tube cover in a shrink state in place into the reservoir.

In FIG. 3, the outer tube 5 is held in place into the reservoir 2, thanks to the cooperation between the collar 6 and the neck 2*a*. To this end, the collar 6 of the tube cover 1 is provided with a flange 9 than can rest on the upper surface of the neck 2*a*, so that the tube cover 1 is hanging into the reservoir 2. The tube cover 1 is still in its shrink state. The outer tube 5 is totally inserted into the reservoir 2 and located below the neck 2*a*.

Figure 4:
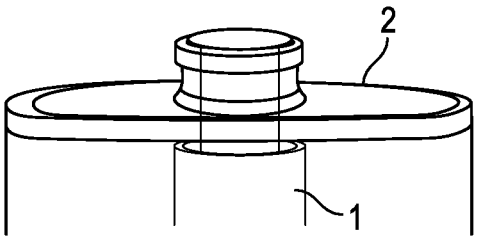
FIG. 4 illustrates a tube cover in an expanded state in place into the reservoir.
Figure 5:
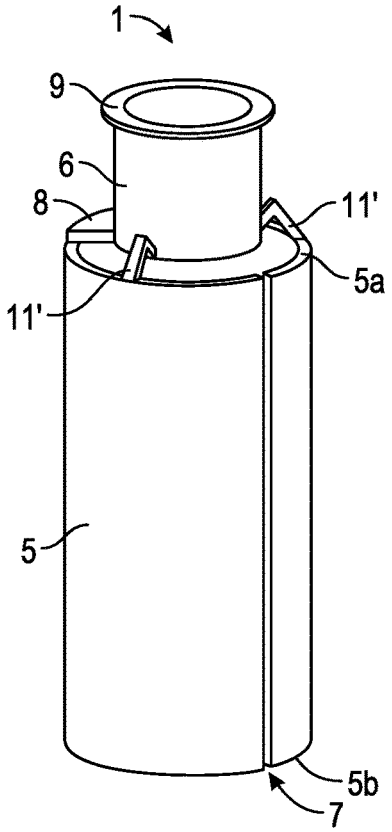
FIG. 5 is a perspective view of a tube cover in a shrink state according to a first embodiment.
Figure 6:
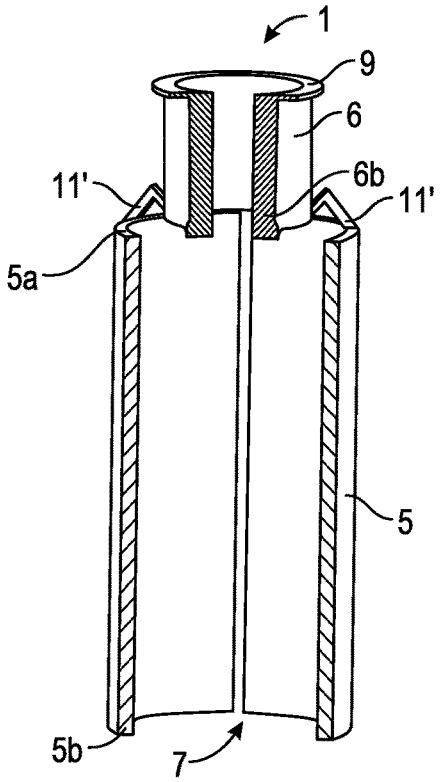
FIG. 6 is partially cut perspective view of the tube cover of FIG. 5.

In FIG. 4, the tube cover 1 is still hanging into the reservoir 2, but in its expanded state. That means that the outer tube 5 is enlarged, and now wider than the diameter of the neck 2*a*. As a result, the surface visible by the user when the flask is in a facing position is extended.

FIGS. 5 to 10 show a first embodiment of the tube cover 1, and FIGS. 11 to 17 show a second embodiment of the tube cover 1. The same references than those of FIGS. 1-4 apply for both embodiments.

The tube cover 1 is in its shrink state in FIGS. 5 to 7 and 11 to 14, and the tube cover 1 is in its expanded state in FIGS. 8 to 10 and 15 to 17.

The collar 6 is connected to the outer tube 5 thanks to a rigid bridge 8. The term "rigid" means that the length of the bridge 8 remains constant whatever the state of the tube cover 1 is.

The outer tube 5 is topped by the collar 6. The bridge 8 links the upper end 5*a* of the outer tube 5 with the lower end 6*b* of the collar 6. The bridge 8 is in the shape of a tab, and extends perpendicularly to the outer tube 5 and to the collar 6. The junction between the bridge 8 and the outer tube 5 is rigid, so as the junction between the bridge 8 and the collar 6. That means that the bridge 8 remains perpendicular to the outer tube 5, and perpendicular to the collar 6, whatever the state of the tube cover 1 is. The angles do not change.

The outer tube 5 and the collar 6 are coaxial along a central axis in the shrink state of the tube cover 1. The technical effect of this bridge 8 is to avoid any relative axial displacement between the outer tube 5 and the collar 6 during the expansion, otherwise there could be an unaesthetic aperture between them.

The collar 6 has a cylindrical wall, with the flange 9 located at the upper end 6*a* of the collar 6. The flange 9 is extending outwardly.

In the present embodiment, the outer tube 5 is composed of a wall having a circular section in the shrink state of the tube cover 1. In other embodiments, the shape of the section could be different, for example squared, hexagonal, octagonal, etc.

As a result, the bridge 8 links the upper end 5*a* of the wall of the outer tube 5 with the lower end 6*b* of the cylindrical wall of the collar 6.

The wall of the outer tube 5 is provided with an axial slit 7. This slit 7 extends over the entire length of the outer tube 5. Thank to this slit 7, the wall can be open in order to modify the shape of the section of the outer tube 5. In other terms, the slit 7 allows the expansion of the tube cover 1.

The slit 7 is preferably diametrically opposed to the bridge 8, in order to facilitate the expansion.

Figure 7:
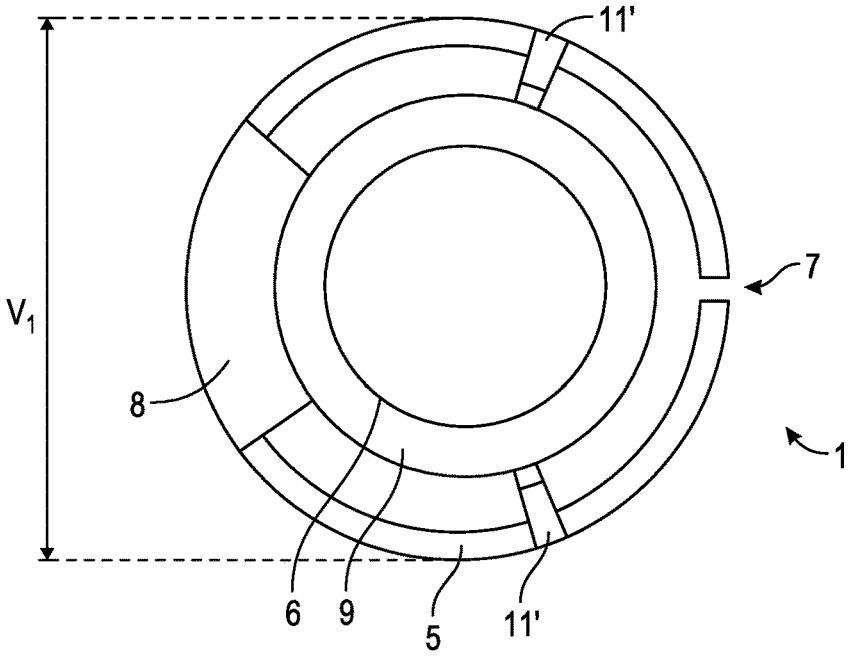
FIG. 7 is a top view of the tube cover of FIG. 5.
Figure 8:
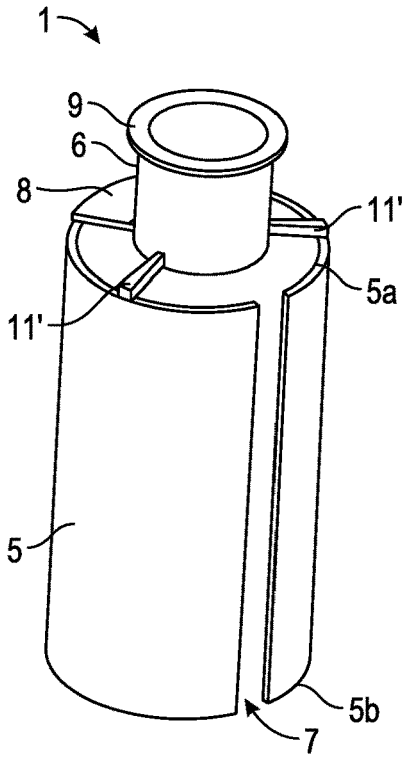
FIG. 8 is a perspective view of the tube cover in an expanded state according to the first embodiment.
Figure 9:
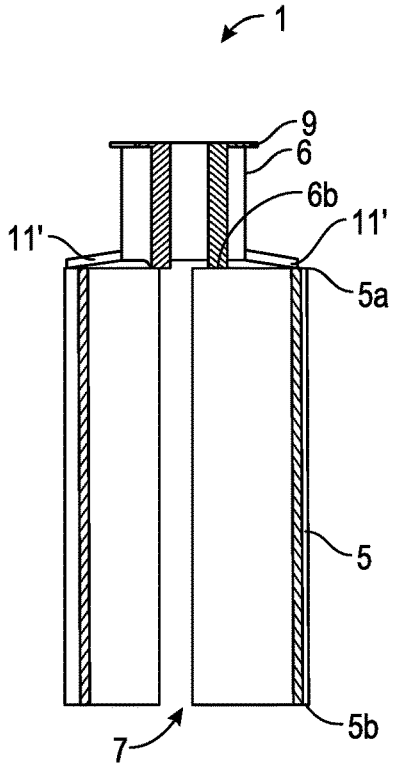
FIG. 9 is partially cut perspective view of the tube cover of FIG. 8.

When the tube cover 1 is in a shrink state, the width of the slit 7 is minimal, and the visible surface V1 that can be seen by a user through the marked face (i.e. when the flask is in a facing position) corresponds to the diameter of the outer tube 5, i.e. the width of the outer tube 5, as depicted in FIG. 7.

To enable the passage of the shrink position to the expanded position, and inversely, the tube cover 1 is provided with means for expanding the outer tube 5. The means for expanding the outer tube 5 spread the slit 7 and increase the width of the outer tube 5.

Figure 10:
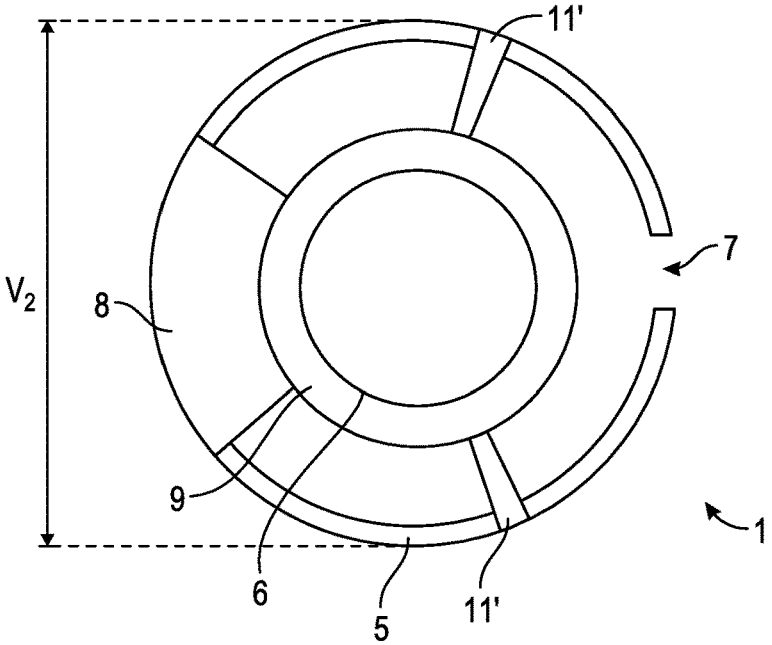
FIG. 10 is a top view of the tube cover of FIG. 8.
Figure 11:
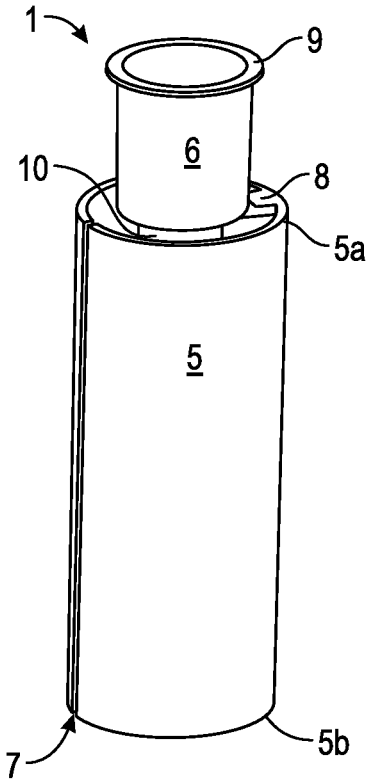
FIG. 11 is a perspective view of a tube cover in a shrink state according to a second embodiment.
Figure 12:
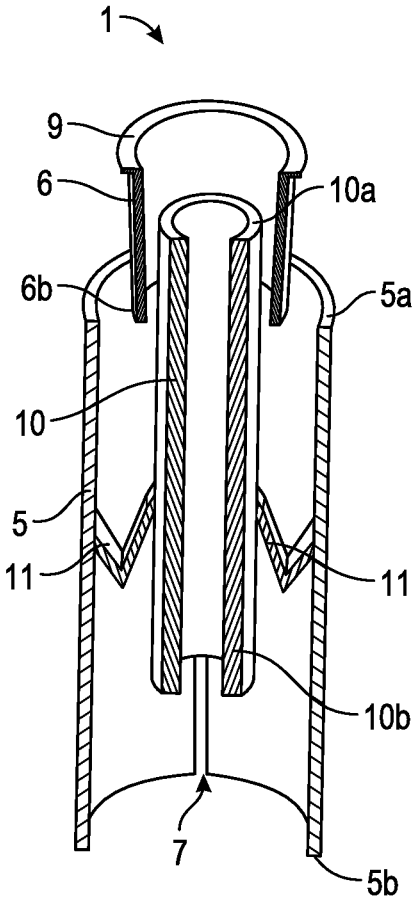
FIG. 12 is partially cut perspective view of the tube cover of FIG. 11.
Figure 13:
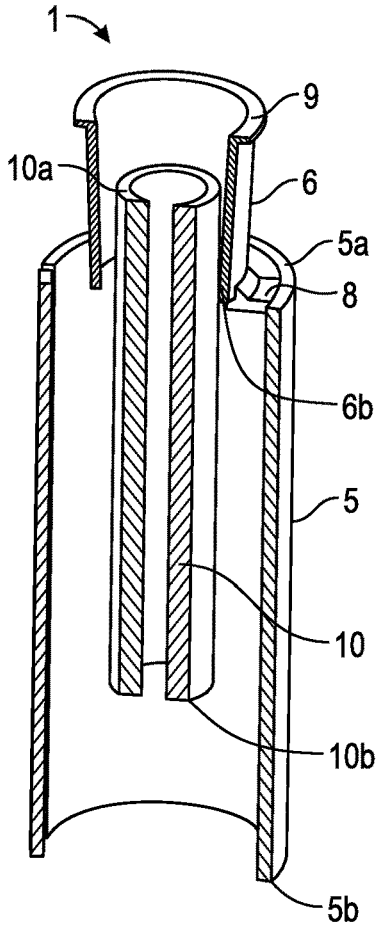
FIG. 13 is another partially cut perspective view of the tube cover of FIG. 11.
Figure 14:
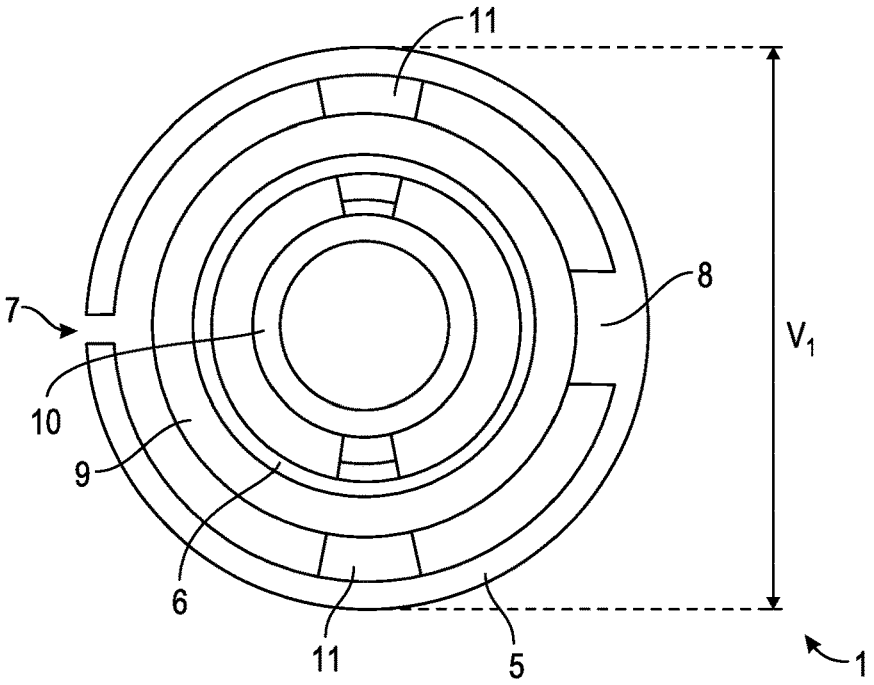
FIG. 14 is a top view of the tube cover of FIG. 11.
Figure 15:
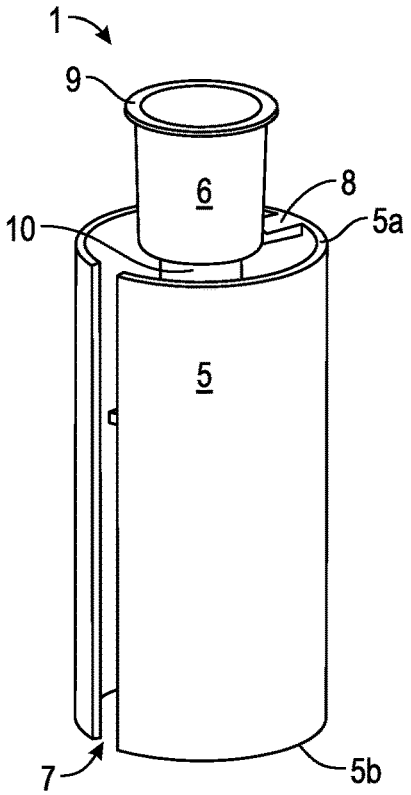
FIG. 15 is a perspective view of the tube cover in an expanded state according to the second embodiment.
Figure 16:
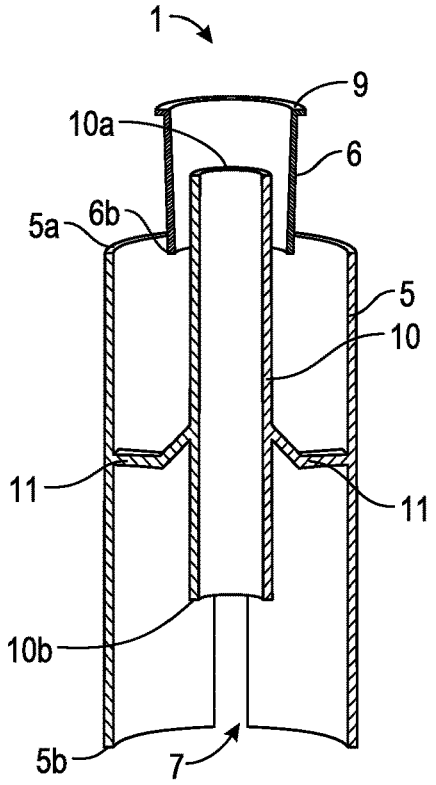
FIG. 16 is partially cut perspective view of the tube cover of FIG. 15.
Figure 17:
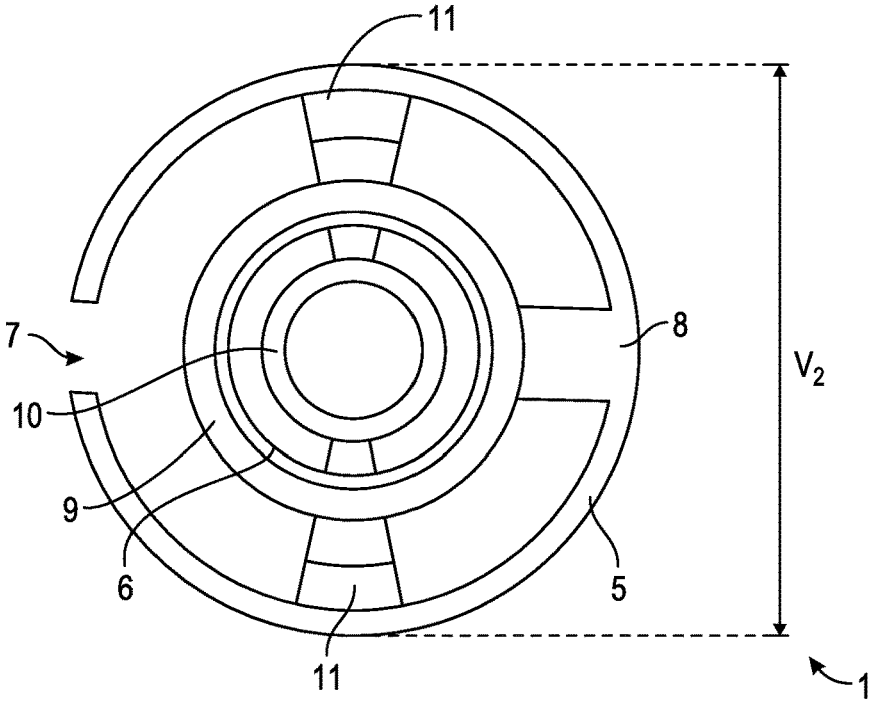
FIG. 17 is a top view of the tube cover of FIG. 15.

The shape of the section of the outer tube 5 is modified when the slit 7 is spread. In the present case, the shape of the section becomes oval or elliptic. As a result, the visible surface V2 that can be seen by a user when the flask is in a facing position corresponds to the big diameter of the outer tube 5, i.e. the biggest width of the outer tube 5, as depicted in FIG. 10. The visible surface V2 is wider than the visible surface V1.

The outer tube 5 is composed of a material having flexible properties for enabling the expansion.

The means for expanding the outer tube 5 consist of articulated legs 11, 11', the tube cover 1 being in the shrink state when the legs 11, 11' are folded, and the tube cover 1 being in the expanded state when the legs 11, 11' are unfolded (deployed).

Preferably, there are two legs 11, 11' located symmetrically on either side of the slit 7. But there can be more legs 11, 11'.

Advantageously, the four key features—i.e. the slit 7, the bridge 8, and the two legs 11, 11'—are substantially in quadrature (90° from each other).

The size of each leg 11, 11' depends on the desired width of the visible surface on the outer tube 5. The longer the legs 11, 11', the wider the surface.

In the first embodiment, the legs 11' are arranged between the outer tube 5 and the collar 6. The legs 11' are fastened to a surface of the outer tube 5 and to a surface of the collar 6. For example, a first end of the legs 11' is fastened to the annular upper edge of the outer tube 5 or to the inner surface of the outer tube 5, and a second end of the legs 11' are fastened to the annular lower edge of the collar 6 or to the outer surface of the collar 6.

In this embodiment, the legs 11' are constrained in the shrink state of the tube cover 1 and are free in the expanded state of the tube cover 1.

When they are free, the legs 11' are more or less straight.

When they are constrained, the legs 11' are deformed, for example with a folding point at the middle of each leg 11'.

For inserting the tube cover 1 into the reservoir 2, it is necessary to hold the outer tube 5 and to tighten it in order to fold the legs 11' and to have a thin slit 7. Then the width of the outer tube 5 is minimal and the tube cover 1 can be inserted into the reservoir 2. Once the outer tube 5 has totally passed the neck 2*a*, then the legs 11' have no more constraints and turn back to their initial state, i.e. straight, and the wall of the outer tube 5 is deployed with a large slit 7.

In the second embodiment, the tube cover 1 further includes an inner tube 10 to accommodate the body 4*b* of the taking off device 4.

The inner tube 10 is located inside the collar 6 and inside the outer tube 5. A bridge 8 links the outer tube 5 to the collar 6, as in the first embodiment.

This inner tube 10 extends over at least a part of the length of the collar 6 and at least a part of the length of the outer tube 5. This inner tube 10 accommodate the plunger tube 3.

The lower part of the body 4*b* can penetrate inside this inner tube 10 and exert a force on the upper end 10*a* of this inner tube 10, i.e. the end 10*a* of the inner tube 10 that is located inside the collar 6 and that is arranged facing the taking off device 4.

The legs 11 are arranged between the outer tube 5 and the inner tube 10. More precisely, the legs 11 are fastened to an inner surface of the outer tube 5 and to an outer surface of the inner tube 10.

The legs 11 are constrained in the expanded state of the tube cover 1 and free in the shrink state of the tube cover 1.

When they are free, the legs 11 are folded, for example with a folding point at the middle of each leg 11.

When they are constrained, the legs 11 are more or less straight, and they push on the wall of the outer tube 5 so as to deploy it.

The inner tube 10 is movable with respect to the outer tube 5 between an upright position where the legs 11 are free and a lowered position where the legs 11 are constrained, the displacement of the inner tube 10 between the upright position and the lowered position causing the expansion of the outer tube 5.

In the shrink state of the tube cover 1, the legs 11 are free and folded, the slit is minimal, the inner tube 10 is in the upright position and the width of the tube cover 1 is minimal. The tube cover 1 can thus be inserted into the neck 2*a* of the reservoir 2 without any difficulty. Once the flange 9 is correctly resting on the neck 2*a* of the reservoir 2, the taking off device 4 can be mounted on the reservoir 2. To this end, the body 4*b* (i.e. the pump) of the taking off device 4 penetrates into the collar 6 of the tube cover 1 until it abuts against the upper end 10*a* of the inner tube 10. The taking off device 4 then pushes on the upper end 10*a* of the inner tube 10 so as to move it to the lowered position, corresponding at the same time to a fastening position of the taking off device 4 in relation with the reservoir 2. When the inner tube 10 moves downwards, the legs 11 are getting deformed with the folding point moving upwardly so as to decrease the angle of the legs 11 and to straighten them.

When the taking off device 4 is fastened to the reservoir 2, the tube cover 1 is in the expanded state, with constrained legs 11 and a large slit 7, and the wall of the outer tube 5 is deployed.

Advantageously, for both embodiments, the legs 11, 11' are connected to the different components by hinges. It can be hinge film type.

Advantageously, the tube cover 1 is made of plastic material for both embodiments.

Advantageously, the tube cover 1 is molded in one piece for both embodiments. The outer tube 5 is integral with the collar 6 and with the legs 11, 11', and also with the inner tube 10 for the second embodiment.

The second embodiment is preferred to the first embodiment because:

the flexible legs, that are unaesthetic, are hidden inside the tube cover, whereas they are visible out of the tube cover for the first embodiment;

the legs are free in the shrink state and it is not necessary to have a step of folding the legs to shrink the tube cover before inserting the tube cover in the neck;

in an assembly line, the legs are unfolded when the pump is inserted: two effects in one single action;

when the pump is removed, the tube cover automatically shrinks and the tube cover can be removed from the neck to separate components for recycling, whereas in the first embodiment the tube cover can not be removed from the reservoir.

Of note, the terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "includes", and/or "including," when used in this specification, specify the presence of stated features, integers, steps, operations, elements, and/or components, but do not preclude the presence or addition of one or more other features, integers, steps, operations, elements, components, and/or groups thereof.

As well, the corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

Having thus described the invention of the present application in detail and by reference to embodiments thereof, it will be apparent that modifications and variations are possible without departing from the scope of the invention defined in the appended claims as follows:

The invention claimed is:

1. A system for dispensing a fluid product, comprising a device for taking off said product under pressure, said device having a pump in communication with a plunger tube, said system further comprising a tube cover surrounding the plunger tube over at least part of its length, wherein the tube cover is expandable between a shrink state and an expanded state, the width of the tube cover in the expanded state being larger than the width of the tube cover in the shrink state.

2. The system according to claim 1 wherein the tube cover comprises an outer tube provided with an axial slit.

3. The system according to claim 2, wherein the tube cover comprises means for expanding the outer tube.

4. The system according to claim 3, wherein the means for expanding the outer tube spread the slit and increase the width of the outer tube.

5. The system according to claim 4, wherein the tube cover comprises a collar to accommodate a neck of a container, the outer tube being directly linked to the collar by means of a rigid bridge.

6. The system according claim 5, wherein said means for expanding the outer tube are arranged between the outer tube and the collar.

7. The system according to claim 6, wherein said means for expanding the outer tube are fastened to a surface of the outer tube and to a surface of the collar.

8. The system according claim 6, wherein said means for expanding the outer tube are constrained in the shrink state of the tube cover and said means for expanding the outer tube are free in the expanded state of the tube cover.

9. The system according to claim 5, wherein the tube cover further comprises an inner tube to accommodate said body.

10. The system according to claim 9, wherein said means for expanding the outer tube are arranged between the outer tube and the inner tube.

11. The system according to claim 10, wherein said means for expanding the outer tube are fastened to a surface of the outer tube and to a surface of the inner tube.

12. The system according to claim 10, wherein said means for expanding the outer tube are constrained in the expanded state of the tube cover and said means for expanding the outer tube are free in the shrink state of the tube cover.

13. The system according to claim 12, wherein the inner tube is movable with respect to the outer tube between an upright position where the means for expanding are free and a lowered position where the means for expanding are constrained, the displacement of the inner tube between the upright position and the lowered position causing the expansion of the outer tube.

14. The system according to claim 13, wherein the mounting of the taking off device on the tube cover occurs the displacement of the inner tube from the upright position to the lowered position.

15. The system according claim 3, wherein said means for expanding the outer tube consist of articulated legs, the tube cover being in the shrink state when the legs, are folded, and the tube cover being in the expanded state when the legs are unfolded and thus deployed.

16. A flask for dispensing a fluid product, comprising:

a reservoir for packaging said product, said reservoir being provided with a neck, a dispensing system that is mounted on the reservoir, the system comprising a device for taking off said product under pressure, said device having a pump in communication with a plunger tube, said system further comprising a tube cover surrounding the plunger tube over at least part of its length, wherein the tube cover is expandable between a shrink state and an expanded state, the width of the tube cover in the expanded state being larger than the width of the tube cover in the shrink state, wherein the plunger tube of the dispensing system is disposed in said reservoir, the tube cover of the dispensing system is provided with a collar that accommodates the neck of the reservoir, and the outer tube is inserted into the reservoir.

* * * * *